US006378155B1

(12) United States Patent
Dobbs

(10) Patent No.: US 6,378,155 B1
(45) Date of Patent: Apr. 30, 2002

(54) HAND-OPERABLE CLEANING TOOL FOR AUTOMOTIVE ENGINE INTAKE COMPONENTS

(75) Inventor: Bruce W. Dobbs, Cinaminson, NJ (US)

(73) Assignee: Calidad Auto Tech, Inc., Saylorsburg, PA (US)

( * ) Notice: Subject to any disclaimer, the term of this patent is extended or adjusted under 35 U.S.C. 154(b) by 0 days.

(21) Appl. No.: 09/716,200

(22) Filed: Nov. 17, 2000

Related U.S. Application Data

(60) Provisional application No. 60/162,638, filed on Nov. 1, 1999.

(51) Int. Cl.[7] ..... A47L 25/00
(52) U.S. Cl. ..... 15/104.94; 15/244.1
(58) Field of Search ..... 15/104.165, 104.94, 15/210.1, 211, 220.1, 244.1

(56) References Cited

U.S. PATENT DOCUMENTS

| | | | | | |
|---|---|---|---|---|---|
| 843,590 | A | * | 2/1907 | Dunn | 15/220.1 |
| 1,421,911 | A | * | 7/1922 | Cohen | 15/104.94 |
| 1,431,881 | A | * | 10/1922 | Ericson-Smith | 15/104.94 |
| 1,478,388 | A | * | 12/1923 | Gray | 15/244.1 |
| 1,649,089 | A | * | 11/1927 | Volckening | 15/244.1 |
| 2,361,395 | A | * | 10/1944 | Gilligan | 15/104.165 |
| 2,755,497 | A | * | 7/1956 | Greacen, Jr. | 15/104.94 |
| 2,929,087 | A | * | 3/1960 | Salmon | |
| 3,205,518 | A | * | 9/1965 | Romaine | 15/211 |
| 5,095,574 | A | * | 3/1992 | Khanzadian | 15/220.1 |
| 5,671,497 | A | * | 9/1997 | Abdo | 15/244.1 |
| 6,240,590 | B1 | * | 6/2001 | Nesbit | 15/244.1 |

* cited by examiner

*Primary Examiner*—Randall E. Chin
(74) *Attorney, Agent, or Firm*—John R. Mugno

(57) ABSTRACT

A handheld cleaning tool for automotive engine intake components is described which is easily manipulated even by non-skilled automobile technicians. The cleaning tool comprises: (i) a handle for griping the cleaning tool; (ii) a flexible, elongated rod shaft having a first end and a second end wherein the first end of the rod shaft is coupled to the handle; (iii) an attachment collar having a first end coupled to the second end of the rod shaft and a second end; and (iv) a pliable cleaning head having a first end removably coupled to the second end of the attachment collar and a second end which includes a high tensile strength sponge designed to fit in and around surfaces of the intake components, and to effectively clean the intake components without damaging, or leaving any undesirable residue on, the surfaces of the intake components. The sponges of the present invention are typically comprised of polyvinyl alcohol to prevent shredding and are easily and inexpensively replaced after they become dirty. The handle of the cleaning tool furthermore includes a gripping overlay that includes slotted finger components and a bore to easily store the cleaning tool on a nail when not in use.

11 Claims, 1 Drawing Sheet

HAND-OPERABLE CLEANING TOOL FOR AUTOMOTIVE ENGINE INTAKE COMPONENTS

This application claims benefit of prov. Ser. No. 60/162,638 filed Nov. 1, 1999.

FIELD OF THE INVENTION

This invention is generally directed to the cleaning of engine intake components in an automobile. More specifically, the handheld cleaning tool of the present invention permits a user to easily grasp an elongated tool having a sponge tip covered in a non-toxic detergent which easily can be manipulated around the surfaces and bores of the intake components of an automobile. The cleaning tool of the present invention permits safe, effective and inexpensive cleaning of the automotive intake components while not damaging the surfaces thereof or leaving behind any undesirable residue.

BACKGROUND OF THE INVENTION

In fuel combustion engines, it is essential that a pure combination of air and fuel be achieved for the engine to run effectively. Regrettably, it is also well known that such engines (particularly the engine intake components therein), accumulate dust, grime, and other undesirable materials that can negatively impact the operation of the engine. This negative impact can take the form of decreased fuel efficiency, inconsistent fuel combustion (which typically feels like "pings" or hesitation to a driver), unacceptably high levels of toxic emissions, worn engine components, or, in severe cases, catastrophic engine failure.

In order to maintain the proper functioning of an internal combustion engine, it is necessary that the intake components be periodically cleaned. In the prior art, auto technicians sometimes utilize simple cloth rags in an attempt to clean the intake components. Regrettably, attempting to clean engine components in such a manner often only worsens the condition. First, the rag is ineffective in reaching small spaces and surfaces of the engine components; therefore, the rag simply further gathers or "clumps" dirt and residue in a more confined area. Secondly, a rag will typically leave behind undesirable lint or even whole pieces of cloth accidentally cut due to the sharp edges of certain intake components.

There are also available in the prior art numerous aerosol cleaning sprays for automotive intake components. While the cleansing capabilities of such products are generally effective, numerous other deficiencies arise. Such aerosol sprays are typically both corrosive and flammable. The corrosiveness of such aerosol sprays can easily damage the automobile's finish if misapplied. Furthermore, if too much spray is utilized, the surfaces of the intake components can be damaged. The flammability of such sprays is dangerous since automobile technicians mistakenly use such sprays on hot engine components. Thus, the possibility of both property damage and personal injury are high.

The prior art aerosol sprays are also extremely expensive to use both in their initial costs, and by the fact that aerosol cans often fail to function properly when stored for long periods of time. The storage of such cain is also often dangerous due to the risk of explosion.

It is therefore a primary object of the present invention to provide a new and improved cleaning tool for automotive engine intake components.

It is another object of the present invention to provide a new and improved cleaning tool for automotive engine intake components that is hand-operable.

It is yet a further object of the present invention to provide a new and improved cleaning tool for automotive engine intake components that is less expensive to use than aerosol cleaning sprays.

It is yet still a further object of the present invention to provide a new and improved cleaning tool for automotive engine intake components that utilizes only non-corrosive materials.

It is another object of the present invention to provide a new and improved cleaning tool for automotive engine intake components that utilizes only non-flammable materials.

It is still another object of the present invention to provide a new and improved cleaning tool for automotive engine intake components that results in no undesirable residue being left on the surfaces of said engine intake components.

Other objects and advantages of the present invention will become apparent from the specification and the drawings.

SUMMARY OF THE INVENTION

Briefly stated and in accordance with the preferred embodiments of the present invention, a handheld cleaning tool for automotive engine intake components is described which is easily manipulated even by non-skilled automobile technicians. The cleaning tool comprises: (i) a handle for griping the cleaning tool; (ii) a flexible, elongated rod shaft having a first end and a second end wherein the first end of the rod shaft is coupled to the handle; (iii) an attachment collar having a first end coupled to the second end of the rod shaft and a second end; and (iv) a pliable cleaning head having a first end removably coupled to the second end of the attachment collar and a second end which includes a high tensile strength sponge designed to fit in and around surfaces of the intake components, and to effectively clean the intake components without damaging, or leaving any undesirable residue on, the surfaces of the intake components. The sponges of the present invention are typically comprised of polyvinyl alcohol to prevent shredding and are easily and inexpensively replaced after they become dirty. The handle of the cleaning tool furthermore includes a gripping overlay that includes slotted finger components and a bore to easily store the cleaning tool on a nail when not in use.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PREFERRED EMBODIMENT

Figure 1:
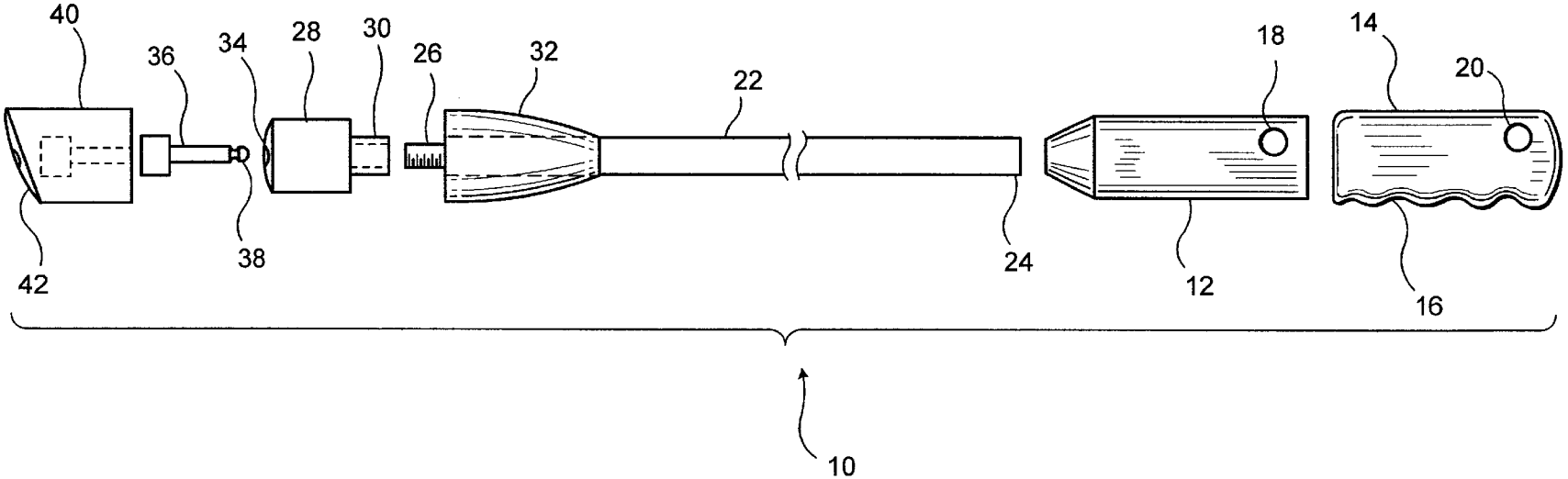
FIG. 1 is an exploded view of a hand-operable engine cleaning tool in accordance with the present invention.

Referring to FIG. 1, a hand-operable engine cleaning tool generally designated 10 is shown in exploded form. Engine tool 10 includes a handle 12 upon which an optional gripping overlay 14 can be placed. While optional gripping overlay 14 can be of different shapes, it is preferred that gripping overlay 14 include finger grip 16 to permit proper orientation and easy manipulation of engine cleaning tool 10. Bore 18 on handle 12 and bore 20 on gripping overlay 14 will align to permit engine cleaning tool 10 to be easily stored on a nail when not in use. An elongated rod shaft 22 has an end 24 which is coupled to handle 12. The coupling of end 24 of elongated rod shaft 22 to handle 12 can be accomplished simply by a tight fit, by threaded grooves, by a fastening glue or other techniques known in the art. While elongated rod shaft 22 can be comprised of various materials, it is preferred that it be comprised of a flexible yet strong material such as nylon. The flexibility of elongated rod shaft 22 will permit the user to easily reach tight spaces of engine components that are being cleaned.

Elongated rod shaft 22 also comprises a second end 26 which will be coupled to an attachment collar 28. While there are various techniques for coupling elongated rod shaft 22 to attachment collar 28, FIG. 1 demonstrates, as an example, a threaded end 30 of attachment collar 28 which is easily coupled to mating threads on end 26 of elongated rod shaft 22.

An optional cover 32 is also shown on FIG. 1. Cover 32 is significantly wider in diameter than both elongated rod shaft 22 and attachment collar 28. The wide diameter of cover 32 is effective in preventing engine cleaning tool 10 from being inserted too far into any engine component. Attachment collar 28 includes a second end 34 to which is attached a nylon core 36. Nylon core 36 has an end 38 which can be locked into end 34 of attachment collar 28. While there are various known means for connecting end 38 of nylon core 36 to end 34 of attachment collar 28, including interlocking features available on most standard rachet sets, in the preferred embodiment of the invention, connectors marketed and available from Colder Products Company of St. Paul, Minnesota have proven to be most effective. It will also be noted that optional cover 32 serves a secondary function of overlaying the connection between end 38 and end 34 thereby providing extra protection to this connection to avoid undesired disconnection of nylon 36 and attachment collar 28.

A sponge attachment 40 is designed to surround nylon core 36 and typically includes a cleaning detergent (preferably a non-flammable detergent) suitable for engine components. While sponge 40 may take on various shapes, a graded edge 42 is preferable since it provides additional cleaning surface. Sponge 40 can be comprised of various materials depending on the pliability, resistance to shredding, and absorption properties desired. Through experimentation, it has been found that air sponge 40 is preferable comprised of polyvinyl alcohol.

The costs associated with utilizing engine cleaning tool 10 is low due to the easy replacement of the sponge head of engine cleaning tool 10. The replacement heads can comprise either sponge 40 alone which overlays nylon core 36 (which is preferable comprised of plastic) or can comprise sponge 40 in combination with nylon core 36. In either case, sponge head replacement is efficient and inexpensive.

While there has been shown and described what is presently considered to be the preferred embodiment of this invention, it will be obvious to those skilled in the art that various changes and modifications may be made without departing from the broader aspects of this invention. For instance, while an inexpensive hand-operable engine cleaning tool has been shown and described having only replaceable sponge heads, it is possible to make the device of components inexpensive enough to render the entire tool disposable.

It is, therefore, aimed in the appended claims to cover all such changes and modifications as fall within the true scope and spirit of the invention.

I claim:

1. A hand-operable tool for cleaning automotive engine intake components in a vehicle comprising:

a handle for gripping said cleaning tooling;

a flexible, elongated rod shaft having a first end and a second end wherein said first end of said rod shaft is coupled to said handle;

an attachment collar having a first end and a second end wherein said first end of said attachment collar is coupled to said second end of said rod shaft;

a cover overlaying said second end of said rod shaft; and a pliable cleaning head having a first end and a second end wherein said first end of said cleaning head is removably coupled to said second end of said attachment collar and said second end of said cleaning head includes a high tensile strength sponge designed to fit in and around surfaces of said intake components, and to effectively clean said intake components without damaging, or leaving any undesirable residue on said surfaces of said intake components.

2. The tool of claim 1 wherein said intake components include a throttle body.

3. The tool of claim 1 wherein said intake components include a throttle plate.

4. The tool of claim 1 wherein said intake components include an air intake tract.

5. The tool of claim 1 wherein said sponge is comprised of polyvinyl alcohol.

6. The tool of claim 1 wherein said rod shaft is comprised of nylon.

7. The tool of claim 1 wherein said cleaning head includes a cylindrical plastic plug core that fastens to said attachment collar.

8. The tool of claim 1 wherein said second end of said rod shaft and said first end of said attachment collar are each threaded so as to permit attachment to each other.

9. The tool of claim 1 wherein said cleaning head is pre-soaked in a non-flammable detergent.

10. The tool of claim 1 further comprises a gripping overlay on said handle.

11. The tool of claim 10 wherein said gripping overlay includes a bore for hanging said tool when not in use.

* * * * *